US009506183B2

(12) United States Patent
Del Pos et al.

(10) Patent No.: US 9,506,183 B2
(45) Date of Patent: Nov. 29, 2016

(54) LAUNDRY WASHING APPLIANCE WITH DOSING DISPENSER

(75) Inventors: Maurizio Del Pos, Pordenone (IT); Giuseppe Dreossi, Stockholm (SE); Mario Filippetti, Campoformido (IT); Nicola Reid, Budoia (IT); Elisa Stabon, Fossò (IT); Andrea Zattin, Solesino (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1356 days.

(21) Appl. No.: 13/319,919

(22) PCT Filed: Apr. 27, 2010

(86) PCT No.: PCT/EP2010/055642
§ 371 (c)(1),
(2), (4) Date: Feb. 28, 2012

(87) PCT Pub. No.: WO2010/130572
PCT Pub. Date: Nov. 18, 2010

(65) Prior Publication Data

US 2012/0159997 A1 Jun. 28, 2012

(30) Foreign Application Priority Data

May 11, 2009 (EP) ..... 09159846

(51) Int. Cl.
*D06F 39/02* (2006.01)

(52) U.S. Cl.
CPC ..... *D06F 39/022* (2013.01); *D06F 39/02* (2013.01); *D06F 39/028* (2013.01)

(58) Field of Classification Search
CPC ..... D06F 39/022; D06F 39/02; D06F 39/028
USPC ..... 68/13 R, 17 R
See application file for complete search history.

(56) References Cited

U.S. PATENT DOCUMENTS

2008/0276661 A1* 11/2008 Bae et al. ..... 68/5 C

FOREIGN PATENT DOCUMENTS

DE 32 46 127 6/1984
DE 601 29 609 5/2008

(Continued)

OTHER PUBLICATIONS

International Search Report mailed Oct. 26, 2010 in corresponding International Application No. PCT/EP2010/055835.

(Continued)

*Primary Examiner* — Jason Ko
*Assistant Examiner* — Levon J Shahnian
(74) *Attorney, Agent, or Firm* — Banner & Witcoff, Ltd.

(57) ABSTRACT

A laundry washing appliance includes a cabinet (105) accommodating a laundry washing tub and a dispensing arrangement for dispensing laundry washing treatment products to be used during laundry washing. The dispensing arrangement includes a drawer (125) slidable within a seat (227) provided in the cabinet (105). The drawer defines at least one container (201*a*, 201*b*) for laundry washing treatment products. At least one suction pump (265*a*, 265*b*) is associated with the at least one container and is fluidly connected to the laundry washing tub for delivering thereto dosed amounts of the treatment products. At least one valve (235*a*, 235*b*; 310, 343*a*, 343*b*; 310*a*, 310*b*, 343*a*, 343*b*) is provided for fluidly connecting the at least one container to the at least one suction pump. The valve is realized so as to automatically close and cut off the fluid connection between the at least one container and the at least one suction pump when the drawer is even partially extracted from the seat, and to automatically open and establish the fluid connection between the at least one container and the at least one suction pump when the drawer is pushed into the seat.

15 Claims, 17 Drawing Sheets

(56) References Cited

FOREIGN PATENT DOCUMENTS

| | | |
|---|---|---|
| EP | 0 528 768 | 2/1993 |
| EP | 1 690 972 | 8/2006 |
| EP | 1 884 584 | 2/2008 |
| EP | 2 011 913 | 1/2009 |
| WO | 2008/010671 | 1/2008 |

OTHER PUBLICATIONS

Extended European Search Report dated Oct. 14, 2009 in related European Application No. 09159846.6.

International Search Report mailed Sep. 17, 2010 in related International Application No. PCT/EP2010/055642.

* cited by examiner

FIG. 4B
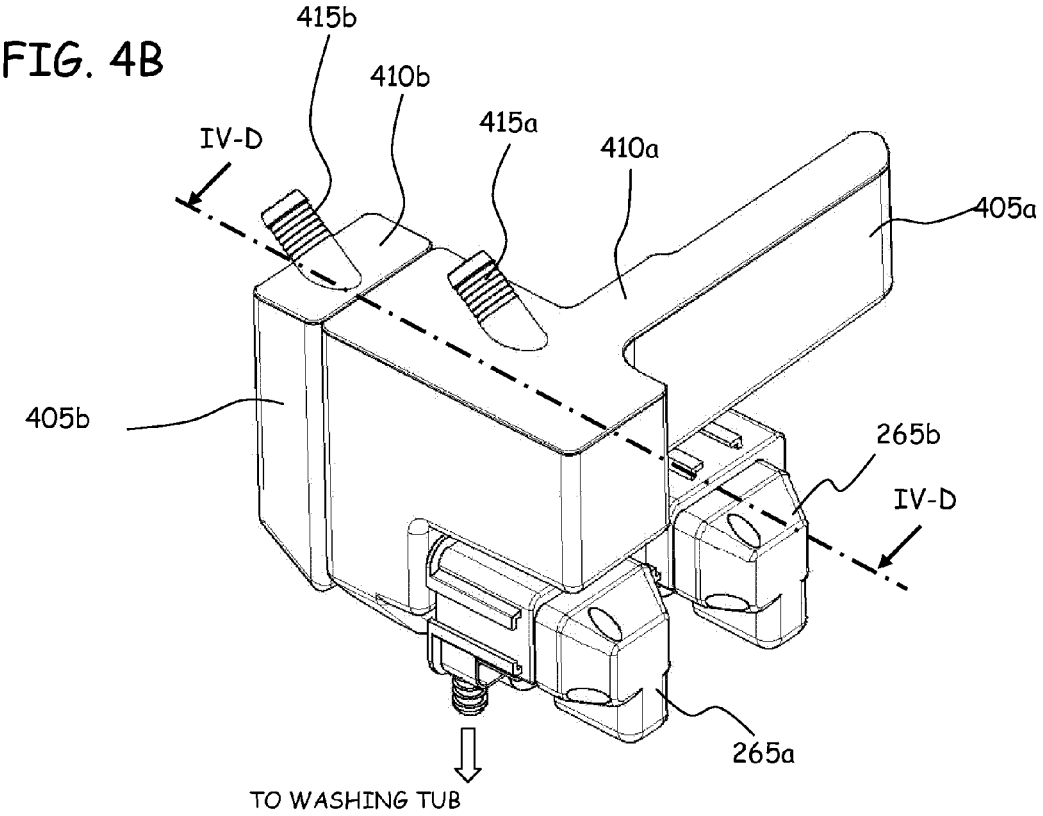
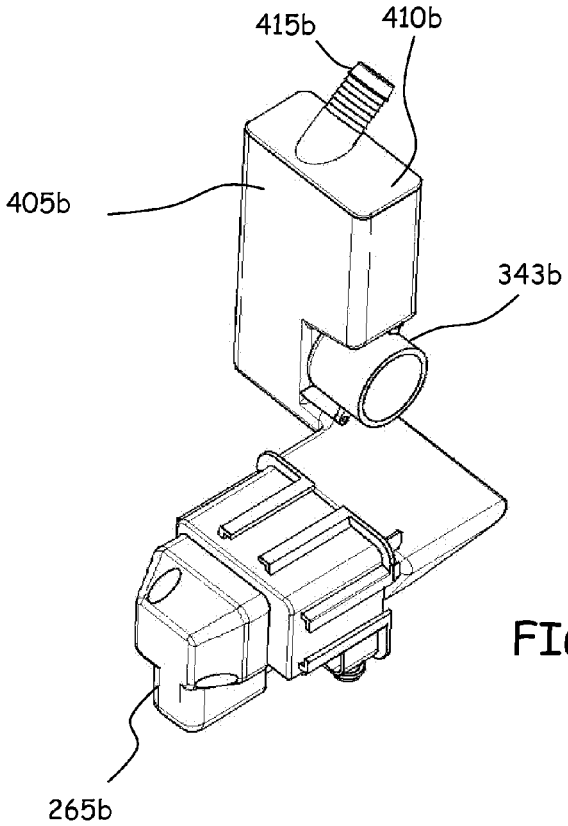
FIG. 4C

LAUNDRY WASHING APPLIANCE WITH DOSING DISPENSER

BACKGROUND OF THE INVENTION

1. Field of the Invention

The present invention relates in general to laundry washing appliances, such as laundry washers or combined laundry washers and dryers. The term "laundry" is here intended to include clothes and garments. In particular, the present invention relates to a laundry washing appliance having an auto-dosing dispensing arrangement for the laundry washing treatments liquids (e.g., detergents, softeners and the like).

2. Description of the Related Art

Laundry washing appliances like laundry washers and combined washers and dryers make use of laundry washing treatments products in the laundry washing cycle; such treatments products include for example detergents and softeners.

The laundry washing appliances generally include receptacles for the laundry treatment products, for example in the form of drawers provided in the appliance cabinet, from where, during the laundry washing cycle, the treatment products are taken and dispensed into the washing tub.

In recent years, the trend has been towards using liquid treatments products, instead of powder ones as in past years. However, the solutions for dispensing the laundry treatment products into the washing tub remained essentially unchanged, despite the evolution in the treatment products typologies and composition, and despite the reductions in the water consumption of the laundry washing appliances.

Auto-dosing dispensing of laundry treatment products to be used during a washing cycle is believed to be advantageous in several respects. For example, it would translate into a reduction of time and efforts of the users, which would be levied from the burden of dosing the correct amount of laundry treatment products, and would beneficially reflect on the environment pollution, because wastes would be reduced or eliminated.

Auto-dosing dispensing of the treatment products in liquid form has proved to be far easier compared to powder products. However, known treatment products dispensing systems are not suitable for liquid treatment products.

WO 2008/010671 describes a laundry drier with a steam generator provided with a detachable water container as a water supply source for the steam generator. The detachable water container is mounted at a drawer, and a water supply path is provided for supplying water to the steam generator from the water container, with a pump preferably installed at the water supply path to help the water of the water container be supplied to the steam generator. When the drawer is moving rearward to an inside of the dryer (the drawer is pushed to the steam generator) to supply water to the steam generator, a pin in the outlet of the water container is moved forward against the elasticity of a spring. As a result, a closable part installed at the pin is separated from the front end of an inner path and water is flowed through the aperture, such that the water of the water container is flowed toward the pump through the path.

On the other hand, when the drawer is pulled forward to re-supply the water to the water container or to drain the water from the steam generator, the closable part installed at the pin closes the front end of the inner path because of the restitution of the spring. As a result, the water inside the water container may not flow in the path further.

SUMMARY OF SELECTED INVENTIVE ASPECTS

The Applicant has tackled the problem of finding an effective solution to the problem of providing an arrangement for auto-dosing of laundry treatment products in laundry washing appliances.

According to an aspect of the present invention, there is provided a laundry washing appliance comprising a cabinet accommodating a laundry washing tub and a dispensing arrangement for dispensing laundry washing treatment products to be used during laundry washing.

The dispensing arrangement comprises a drawer slidable within a seat provided in the cabinet.

The drawer defines at least one container for laundry washing treatment products.

The dispensing arrangement comprises at least one suction pump associated with the at least one container and fluidly connected to the laundry washing tub for delivering thereto dosed amounts of the treatment products.

At least one valve is provided for fluidly connecting the at least one container to the at least one suction pump, said valve being realized so as to automatically close and cut off the fluid connection between the at least one container and the at least one suction pump when the drawer is even partially extracted from the seat, and to automatically open and establish the fluid connection between the at least one container and the at least one suction pump when the drawer is pushed into the seat.

The dispensing arrangement may preferably comprise a mixing chamber, the at least one suction pump associated with the at least one container being fluidly connected to the mixing chamber for delivering thereto dosed amounts of the treatment products, the mixing chamber being fluidly connected to a water inlet and to the laundry washing tub.

The at least one valve preferably comprises at least a valve portion that is attached to the drawer seat, said valve portion being arranged either at the top of the drawer seat, so that the drawer is slidable within the seat below the at least one valve, or at the bottom of the drawer seat, so that the drawer is slidable within the drawer seat above the valve portion.

In a preferred embodiment, said at least one valve comprises:

- at least one valve body;
- at least one fluid passage cut-off member movable within the valve body between a first position in which the fluid passage is cut off, and a second position in which the fluid passage is enabled;
- a respective bias member associated with the at least one fluid passage cut-off member for biasing it into the first position when the drawer is even partially extracted from the seat, and
- a push member for pushing the bias member into the second position against the action of the bias member when the drawer is pushed into the seat.

The valve body may be mounted to the drawer seat, and the push member is mounted on the drawer.

The push member may comprise a first, terminal portion of a suction pipe having a second portion penetrating into the container.

The first, terminal portion of the suction pipe may be arranged at the top of the drawer, and the valve body may be arranged at the top of the drawer seat, so that the drawer is slidable within the drawer seat below the valve body.

The at least one valve body may comprise a first valve body, mounted to the drawer, and a second valve body, mounted to the drawer seat in alignment to the first valve body, each of the first and second valve bodies having a respective fluid passage cut-off member movable therewithin and biased by respective bias member into the first position when the drawer is even partially extracted from the seat, the fluid passage cut-off members having facing ends which, when the drawer is pushed into the seat, abut one against the other, thereby each of the fluid passage cut-off members acts as a push member for pushing the other fluid passage cut-off member into the second position.

The first valve body may be mounted at the bottom of the drawer, below said at least one container, and the second valve body may be mounted at the bottom of the drawer seat, so that the drawer is adapted to slide within the drawer seat above the second valve body.

A water feed channel may be provided, connected to an outlet of at least one electrovalve which in use is connected to an external water main, the water feed channel being fluidly connected to the mixing chamber.

An inlet into the mixing chamber of the treatment product delivered by the suction pump is preferably located above an entrance into the mixing chamber of the water feed channel.

Preferably, the mixing chamber and/or the water feed channel are in single-piece construction with the drawer seat.

A vapours discharge path is preferably provided, fluidly connected to the washing tub for discharging vapours that, in operation, originate within the washing tub.

The vapours discharge path may comprise an air space formed at the bottom of the drawer seat and a discharge opening into the cabinet.

Said at least one container may comprise two containers, respectively for a washing detergent and for a softener.

At least one laundry washing treatment product tank may be provided, fluidly connected to the at least one container by means of said at least one valve, an inlet of said at least one suction pump being connected to the tank, thereby the at least one suction pump being arranged to suck dosed amount of treatment products from the treatment product storage tank.

The at least one suction pump is preferably a positive displacement pump, operable to suck from the at least one container predetermined doses of the laundry washing treatment products.

BRIEF DESCRIPTION OF THE DRAWINGS

These and other features and advantages of the present invention will be made apparent by the following detailed description of some exemplary and non-limitative embodiments thereof. For best intelligibility of the description, reference should be made to the attached drawings, wherein:

FIG. 2A shows in perspective view the drawer for pouring laundry treatment products, in a partially pulled-out, open condition;

FIG. 2B shows, in perspective from a different angle, the drawer of FIG. 2A fully extracted from a respective seat provided in a cabinet of the laundry washing appliance;

FIG. 2C is a partial cross-sectional view taken along plane II-C-II-C of FIG. 2A;

FIG. 2D shows the drawer of FIG. 2A in a closed condition (fully pushed into its seat);

FIG. 2E is a partial cross-sectional view taken along plane II-E-II-E of FIG. 2D;

FIG. 3A shows in perspective view the drawer for pouring laundry treatment products in a fully pulled-out condition (removed from its seat);

FIG. 3B shows, in perspective from below, the drawer fully inserted into its seat;

FIG. 3C is a partial cross-sectional view taken along plane III-C-III-C of FIG. 3A;

FIG. 3D is a partial cross-sectional view taken along plane III-D-III-D of FIG. 3B;

FIGS. 4A-4C show a solution according to still another embodiment of the present invention, and in particular:

FIG. 4A shows in perspective view the drawer for pouring laundry treatment products fully inserted into its seat;

FIG. 4B shows in perspective an arrangement of tanks for storing laundry treatment products, with associated suction pumps;

FIG. 4C shows in perspective one of the tanks of FIG. 4B, and the associated pump;

DETAILED DESCRIPTION OF EMBODIMENTS OF THE INVENTION

Figure 1:
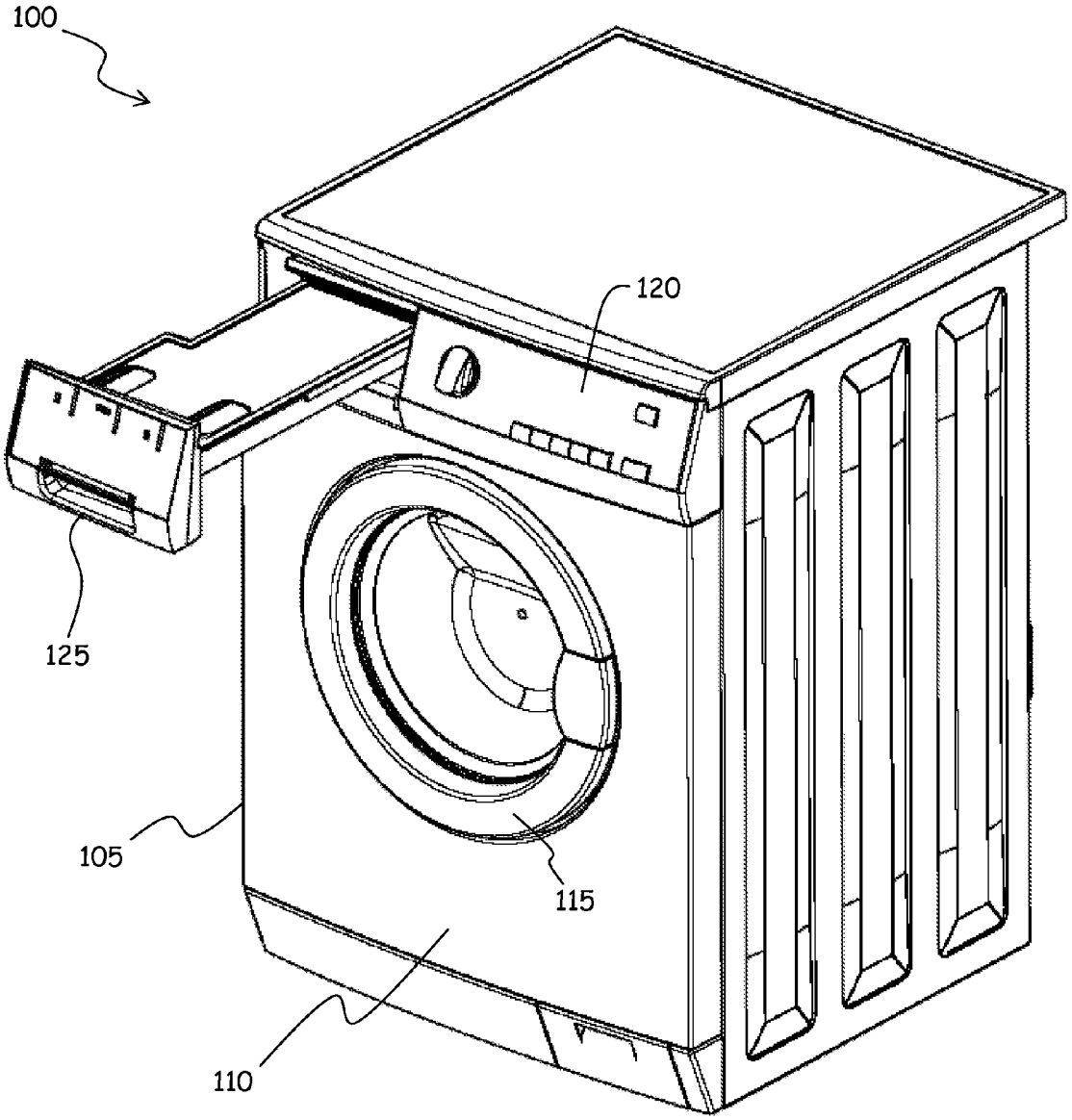
FIG. 1 is a perspective view of a laundry washing appliance where solutions according to embodiments of the present invention are implemented, provided with a drawer for pouring laundry treatment products.

Making reference to the drawings, in FIG. 1 there is shown a laundry washing appliance 100 according to an embodiment of the present invention. In particular, the laundry washing appliance 100 is, in the considered example, a laundry washer, nevertheless the solutions that will be described hereinafter can be applied as well and straightforwardly to other types of laundry washer appliances, for example to combined laundry washers and driers.

The laundry washer 100 comprises an external cabinet 105, within which a washing tub accommodating a rotating washing drum is housed (neither the washing tub, nor the drum are visible in the drawing, being per-se conventional and not relevant for the understanding of the invention embodiments to be described). A front wall 110 of the cabinet 105 is provided with an aperture with which there is associated a door 115, for enabling the user to access the washing drum so as to load/unload the items to be washed. Frontally to the cabinet 105, essentially at the top thereof, a machine control panel 120 is provided, with operational input and setting devices (like for example pushbuttons, rotary selectors and the like) through which the user can set the desired washing preferences, and display devices.

The laundry washer 100 is equipped with a dispensing arrangement for dispensing laundry washing treatments products, e.g. detergents and softeners, to the washing tub. The dispensing arrangement comprises, located aside the control panel 120, a drawer 125, slidably accommodated in a drawer seat (denoted 227 in the following figures and described in detail later on) provided in the cabinet 105 and extending essentially from the front to the rear of the machine; the drawer, as will be described in the following, is intended to be exploited by the user for loading laundry washing treatments products to be used during laundry washing cycles.

In the following, several exemplary and non-limitative solutions are described for the treatment products dispensing arrangement.

Figure 2A:
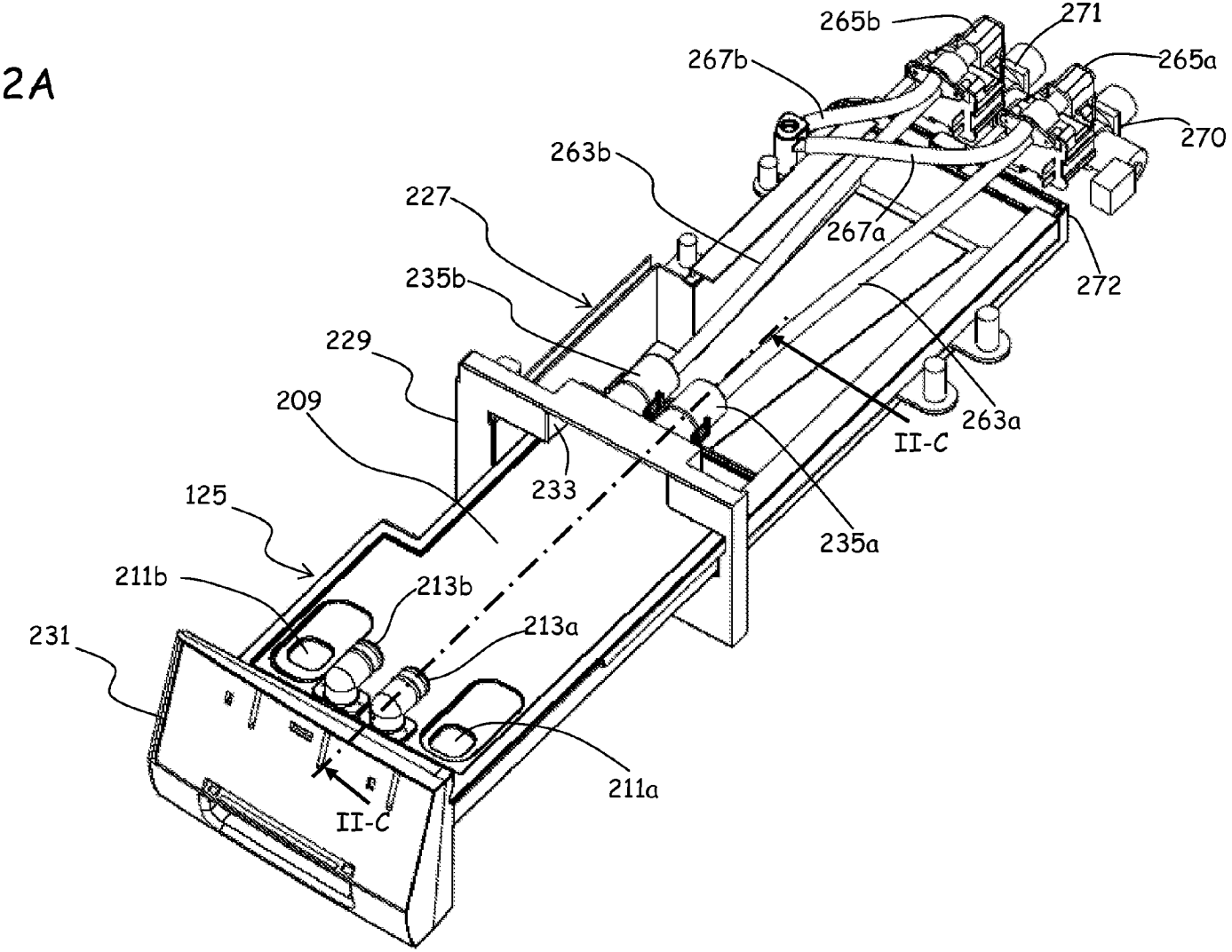
FIGS. 2A-2E show a solution according to an embodiment of the present invention, and in particular.
Figure 2B:
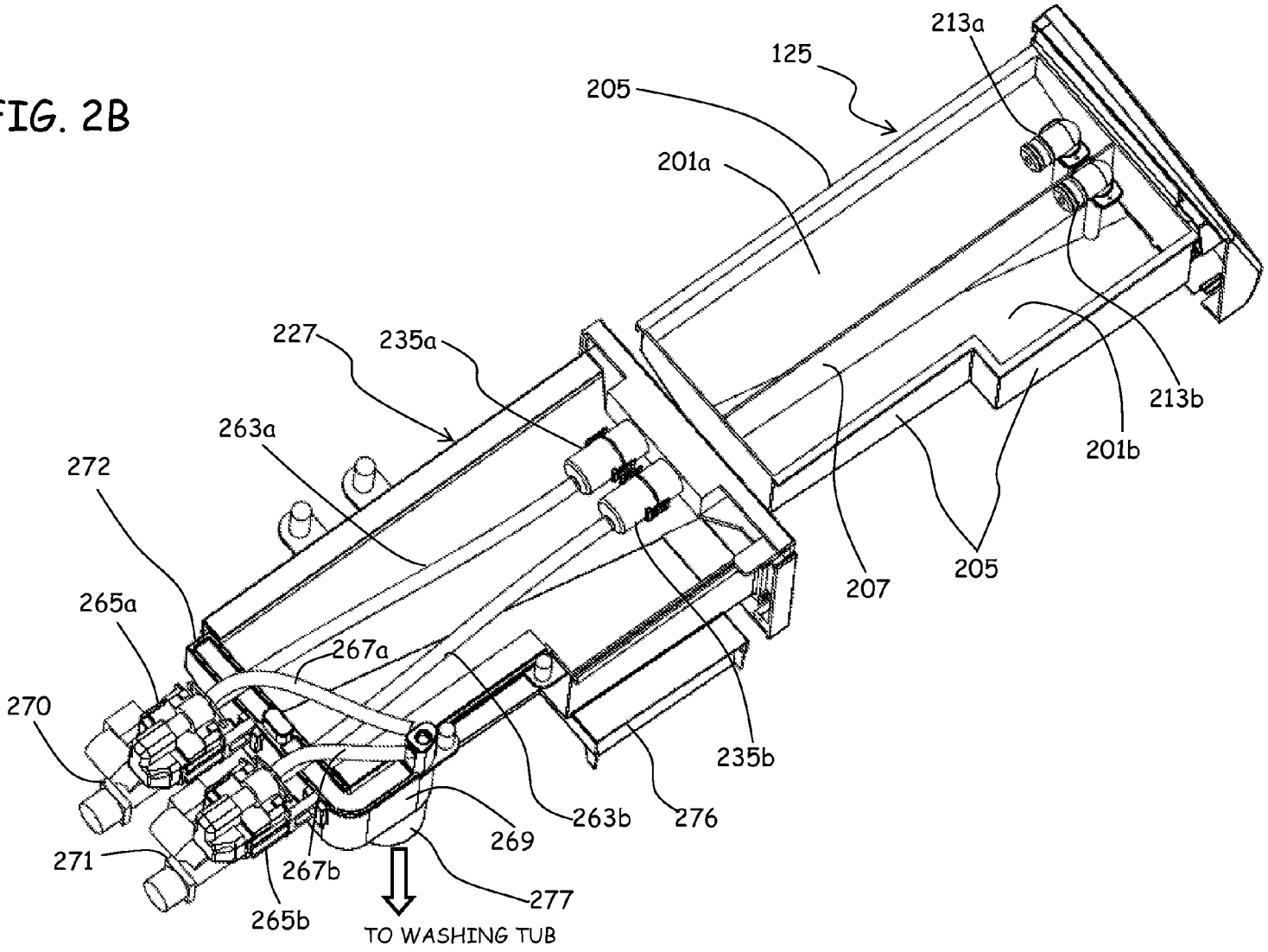
Figure 2C:
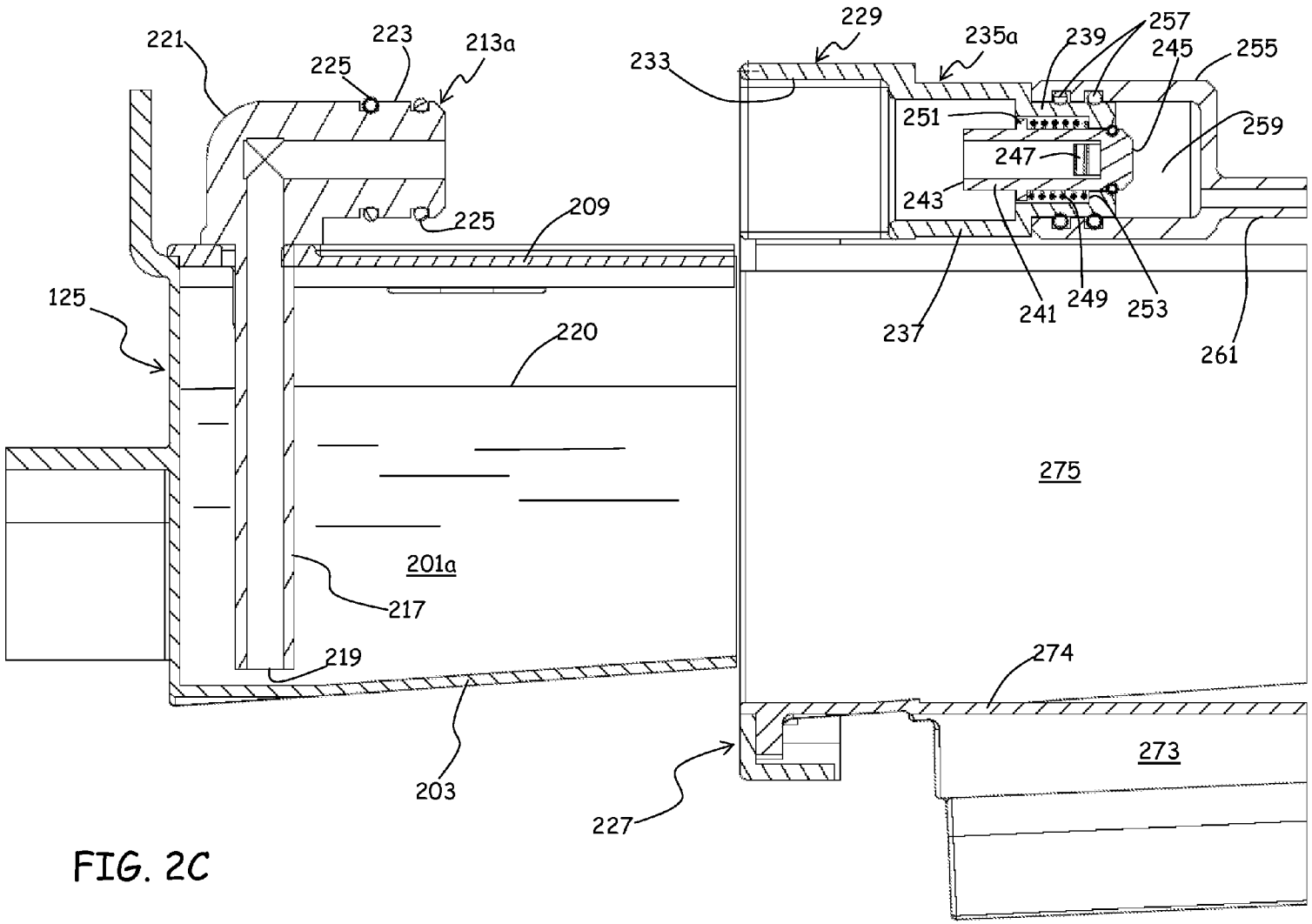
Figure 2D:
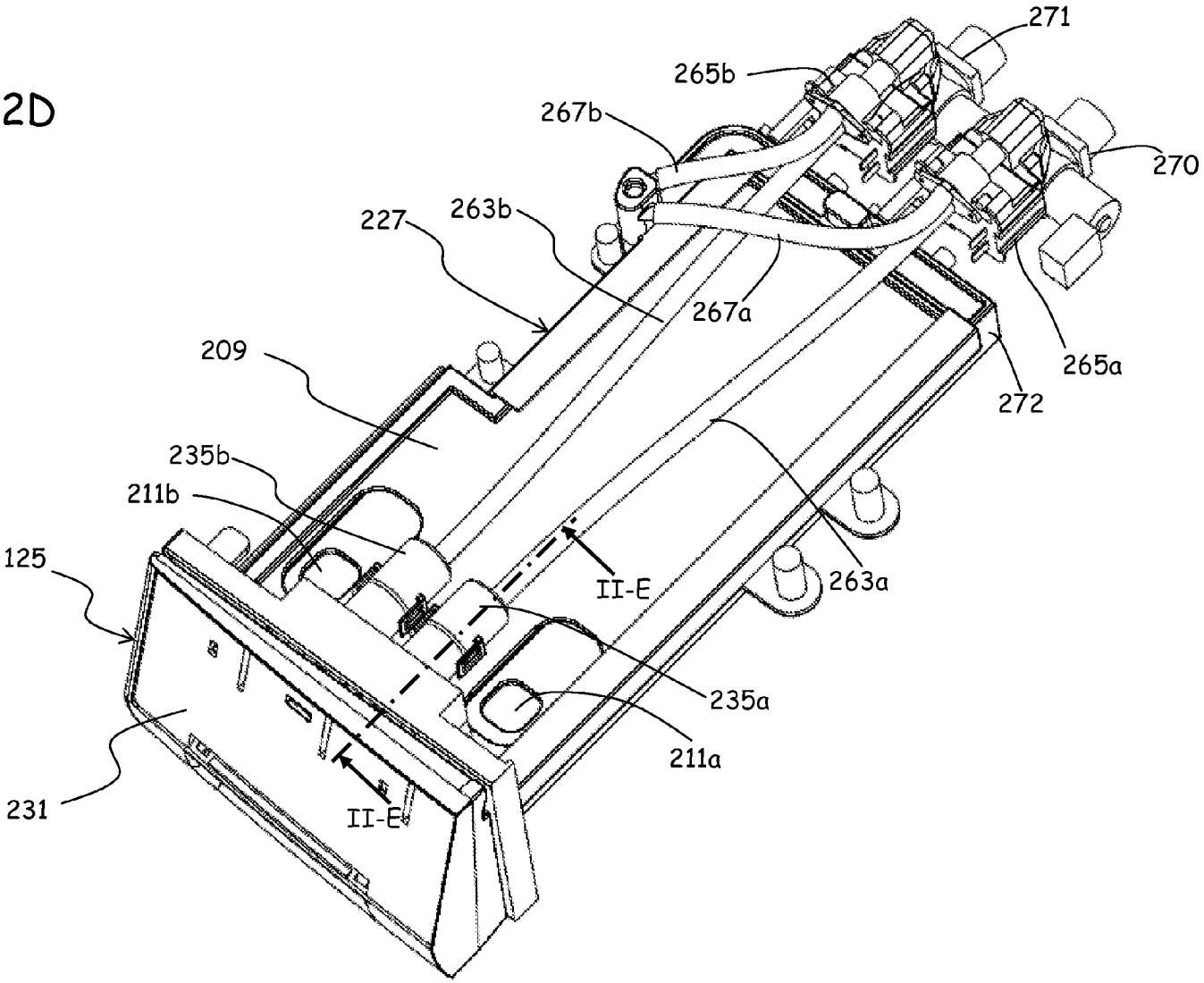
Figure 2E:
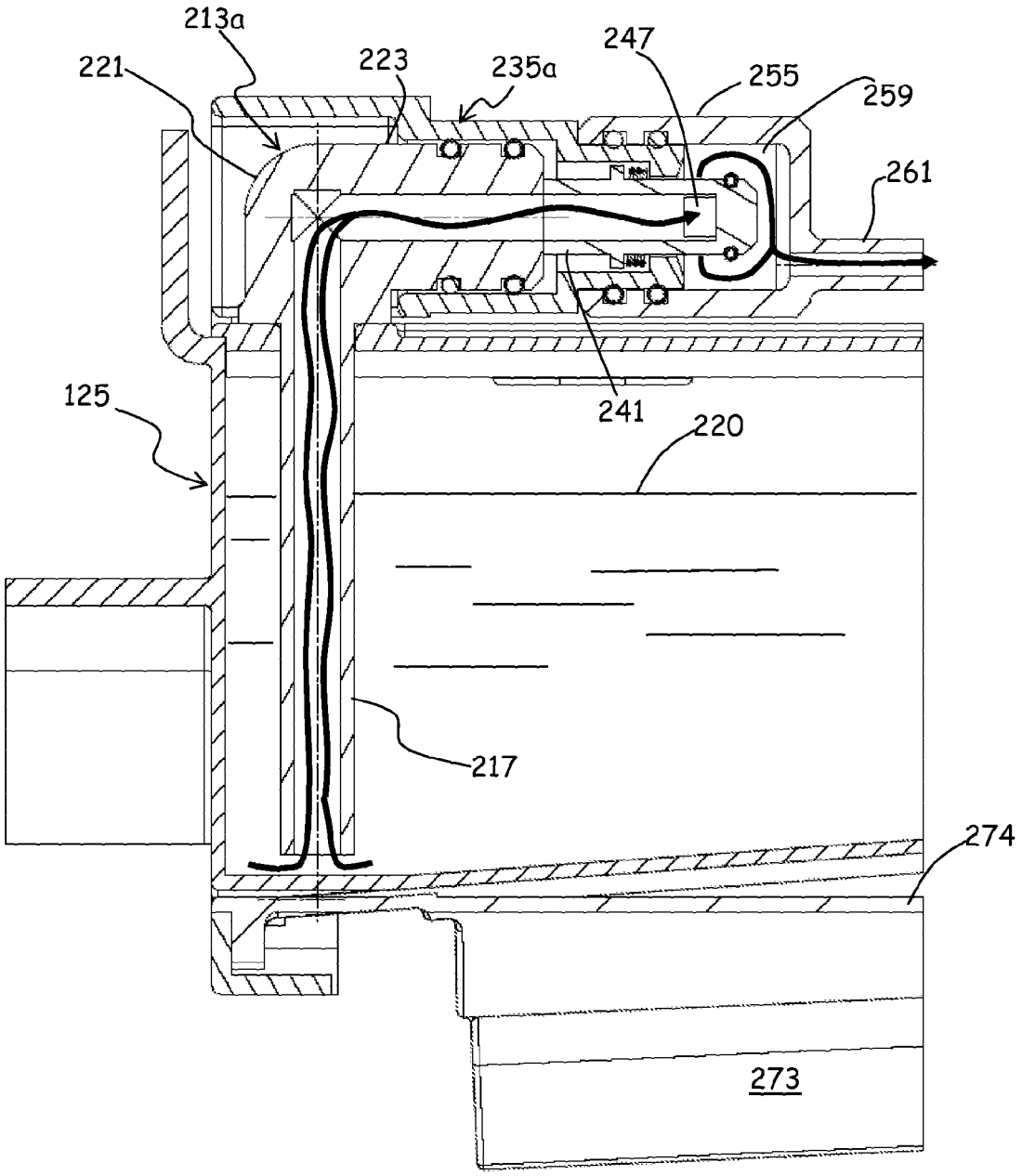
Figure 2F:
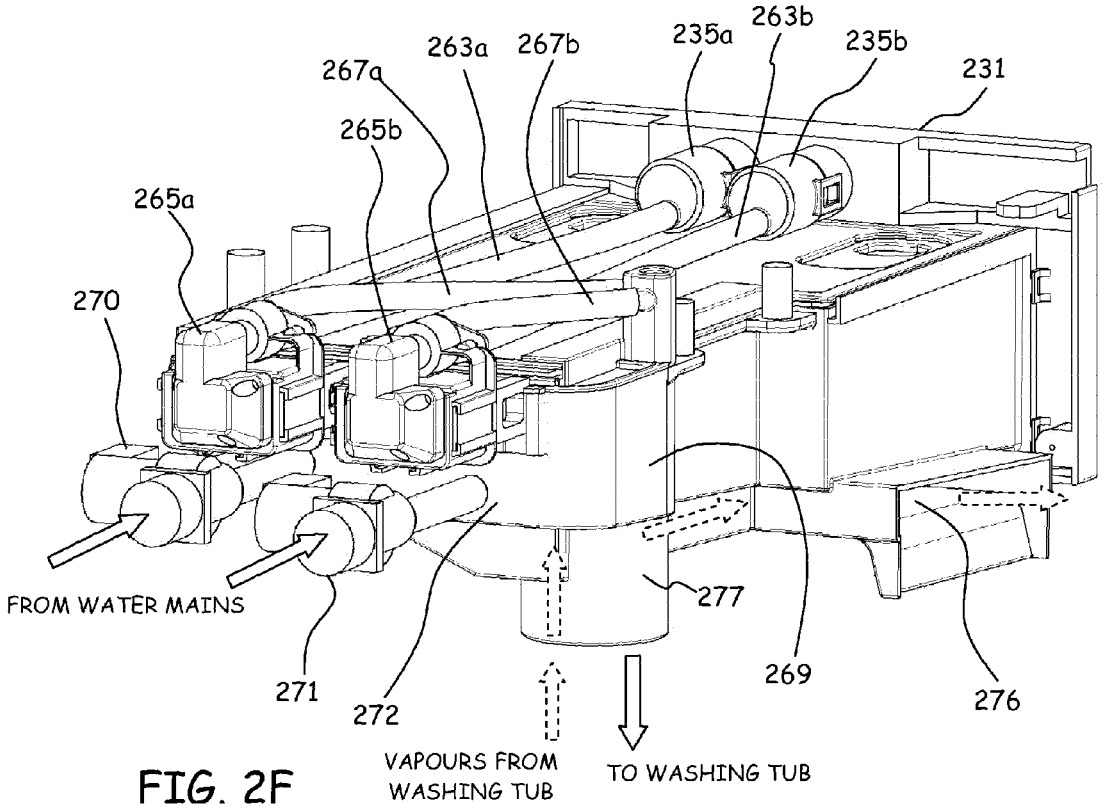
FIG. 2F is a perspective view from the rear of the drawer and seat assembly.
Figure 2G:
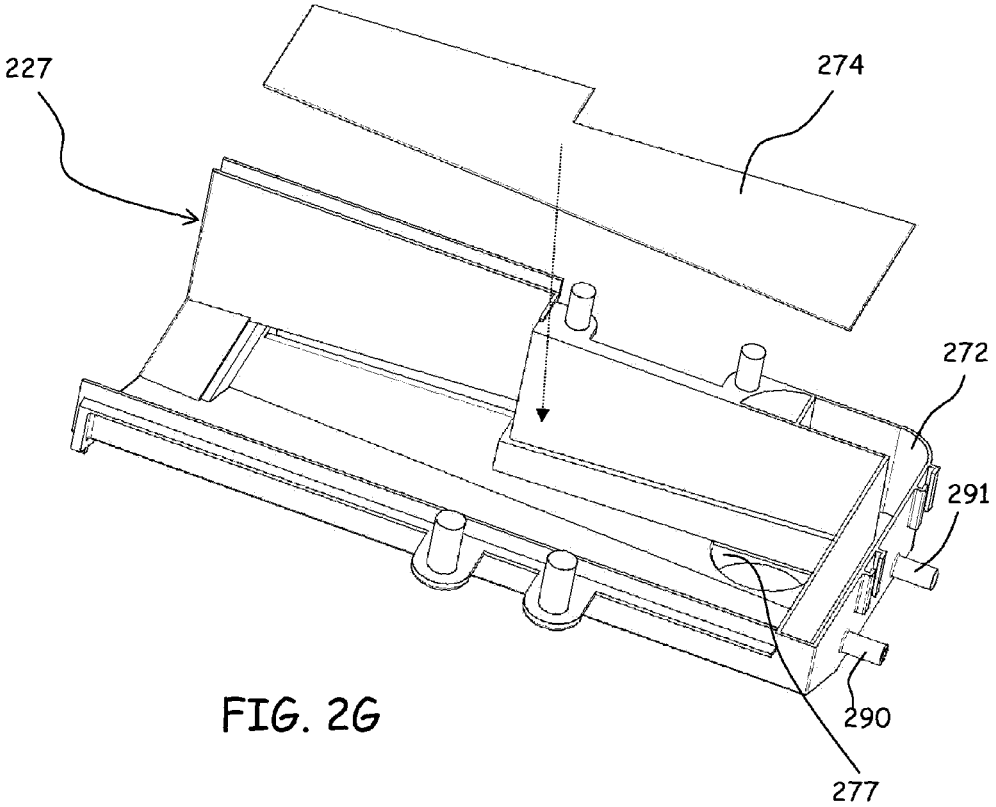
FIG. 2G is a perspective and exploded view of a bottom part of the drawer seat.
Figure 2H:
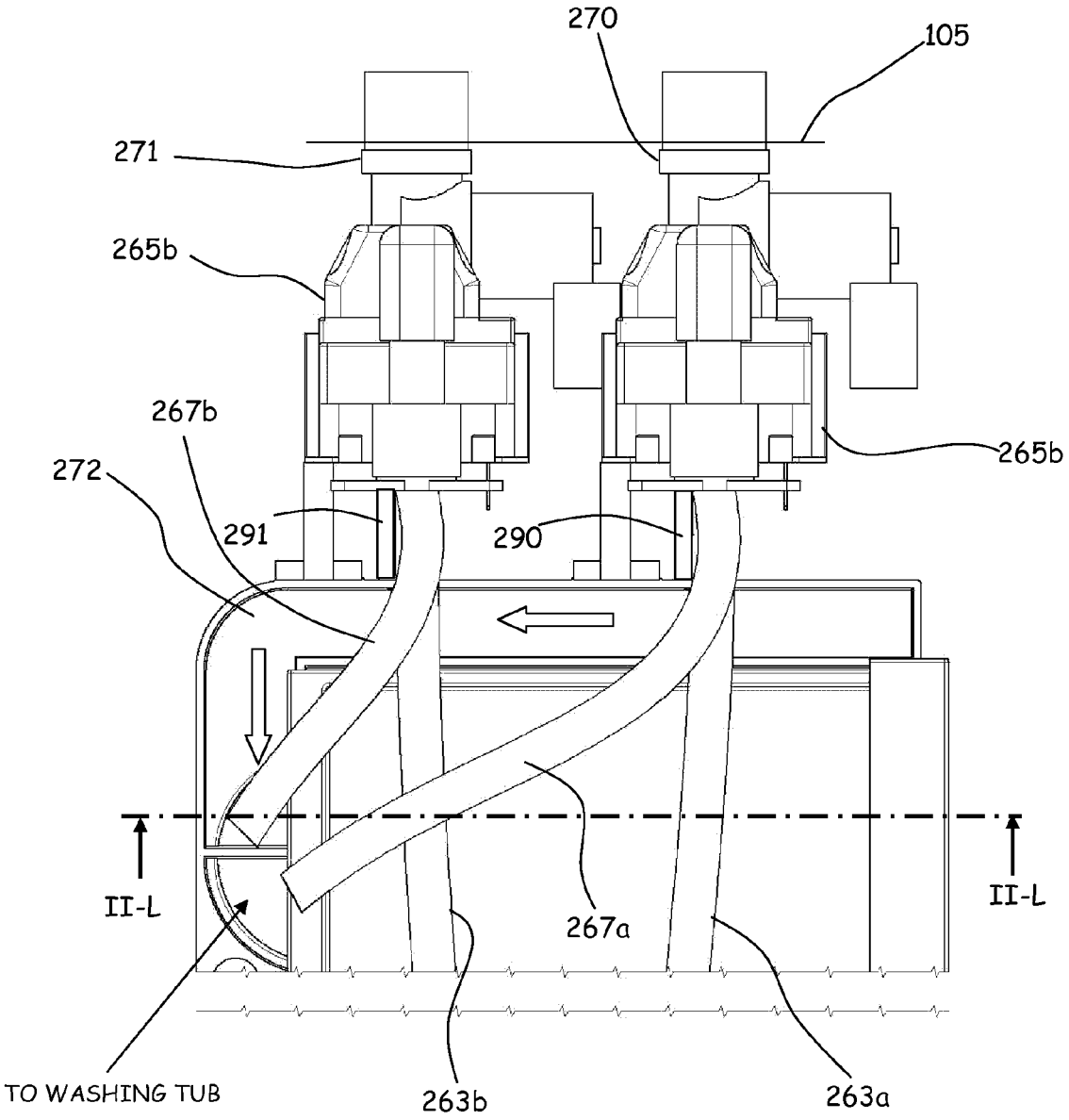
FIG. 2H is a top view of the rear part of the drawer seat.
Figure 2L:
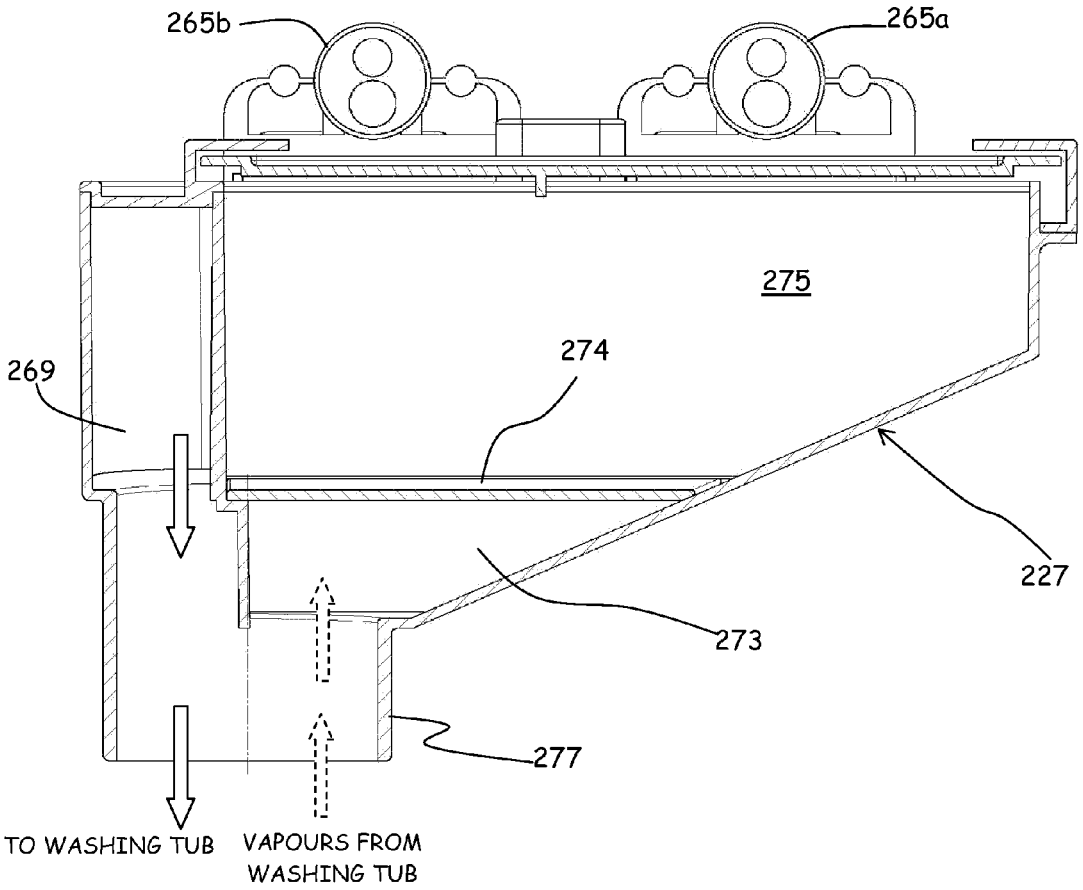
FIG. 2L is a cross-sectional view of the drawer seat taken along plane II-L-II-L of FIG. 2H (with the pipes to/from the pumps not shown for better intelligibility)

A first solution is shown in FIGS. 2A-2L. In greater detail, FIG. 2A shows in perspective view the drawer 125 in a partially pulled-out, open condition (partially extracted from its seat); FIG. 2B shows, in perspective from a different angle, the drawer 125 fully extracted from the seat; FIG. 2C is a partial cross-sectional view taken along plane II-C-II-C of FIG. 2A; FIG. 2D shows the drawer 125 in a closed condition (wherein the drawer 125 is fully pushed into its seat); FIG. 2E is a partial cross-sectional view taken along plane II-E-II-E of FIG. 2D; FIG. 2F is a perspective view from the rear of the drawer and seat assembly; FIG. 2G is a perspective and exploded view of a bottom part of the drawer seat; FIG. 2H is a top view of the rear part of the drawer seat; and FIG. 2L is a cross-sectional view of the drawer seat taken along plane II-L-II-L of FIG. 2H (with some components not shown for better intelligibility).

The drawer 125 is shaped so as to define two containers 201*a* and 201*b* (visible in FIG. 2B) for two different laundry washing treatments products in liquid form; for example, the container 201*a*, of higher capacity, is for the washing detergent, and the container 201*b* is for the softener. The two containers 201*a* and 201*b* are defined by the drawer bottom wall 203 and by the drawer lateral, perimeter walls 205, and are separated by an intermediate wall 207 rising from the bottom wall 203 of the drawer 125 and extending the whole length thereof. The drawer bottom wall 203 is inclined towards the drawer front, so that the height of the two containers 201*a* and 201*b* decreases going from the drawer front towards the rear thereof. The two containers 201*a* and 201*b* are open at the top, and a (preferably) removable cap 209 is provided for closing the two containers (by removing the cap 209, the user may gain access to the containers for, e.g., cleaning purposes). In the cap 209, load apertures 211*a* and 211*b* are provided, one over each of the containers 201*a* and 201*b*, for pouring the proper treatment product into the containers.

Associated to the cap 209 are two suction pipes 213*a* and 213*b*, one in correspondence of the detergent container 201*a* and the other in correspondence of the softener container 201*b*. The suction pipes 213*a* and 213*b*, one of which (213*a*) is visible in the cross-sectional views of FIGS. 2C and 2E, comprise each a vertical pipe portion 217 penetrating into the respective container substantially down to the bottom thereof (so that, when the container 201*a* or 201*b* is filled with the proper treatment product, an aperture 219 at the bottom of the vertical pipe portion 217 is located well below the level of the treatment product surface 220), and an elbow portion 221 positioned over the cap 209; on a free end portion 223 of the elbow portion 221, a pair of O-rings 225 are fit in respective annular notches.

The drawer seat, overall denoted 227, is shaped so as to slidably accommodate the drawer 125 and guide the drawer in the extraction/insertion movements. The drawer seat 227 comprises a front frame 229 for the abutment of a drawer front panel 231; the front frame 229 has a recess 233 formed in a top side thereof, the recess 233 being adapted to allow the passage of the elbow portions 221 of the two suction pipes 213*a* and 213*b* when the drawer 125 is fully pushed into the cabinet 105 (a condition in which the drawer front panel 231 results essentially flush with the control panel 120).

Two valves are formed in the drawer seat 227. Each of the two valves comprises a hollow valve body 235*a*, 235*b* protruding from the front frame 229 towards the rear of the cabinet 105; the two valve bodies 235*a* and 235*b*, which in the shown exemplary embodiment are formed in one piece with the front frame 229, are positioned so as to result aligned to the elbow portions 221 of the two suction pipes 213*a* and 213*b*, and have a first portion 237 of shape and size adapted to tightly receive therein the free end portion 223 of the elbow portions 221 of the suction pipes 213*a* and 213*b*, the O-rings 225 provided on the free end portion 223 ensuring a tight seal when the free end portions 223 of the elbow portions 221 are inserted into the first portion 237 of the valve bodies 235*a* and 235*b*. The valve bodies 235*a* and 235*b* have a second portion 239 following the first portion 237 and accommodating a slidable valve member 241 forming a fluid passage cut-off element. The slidable valve member 241 is a hollow, generically cylindrical member, open at a first base 243 thereof facing the elbow portions 221, and closed at an opposite, second base 245, with one or more apertures 247 formed in the perimeter wall thereof in correspondence of the second base 245, the aperture(s) 247 putting the hollow interior of the valve member 241 into fluid communication with the exterior. A bias helical spring 249 is fit outside the valve member, between an annular ridge 251 projecting from the valve member 241 perimeter wall and a shoulder 253 formed at the end of the second portion 239 of the valve bodies 235*a* and 235*b*.

A pipe coupling 255 is fit onto the second portion 239 of the valve bodies 235*a* and 235*b*, with a couple of O-rings 257 fit on each of the valve body second portions 239 for ensuring the seal; the pipe coupling 255 extends farther towards the rear of the cabinet 105 with respect to the second portion 239 of the valve bodies 235*a* and 235*b*, to define a liquid chamber 259, and terminates with a nipple 261 adapted to the connection of a flexible pipe 263*a*, 263*b* leading to the intake of a respective suction pump 265*a*, 265*b*.

According to an embodiment of the present invention, the two pumps 265*a* and 265*b* are positive displacement pumps, for example volumetric pumps, reciprocating pumps, gear pumps, and are adapted to displace dosed amounts of liquids. The two pumps 265*a* and 265*b* have each a delivery outlet which is fluidly connected, by means of a respective flexible pipe 267*a* and 267*b*, to respective inlets of a mixing chamber 269, located at a rear corner (in particular, but not limited to, the rear left corner as seen from the front) of the seat 227 for the drawer 125; preferably the mixing chamber 269 is in a single-piece construction with the drawer seat 227, and is obtained by a plastic injection-moulding process.

Outlets of two electrovalves 270 and 271 are fluidly connected, through respective conduits 290 and 291, to a water load chamber 272, located behind the drawer seat 227 and for example in one piece therewith. The water load chamber 272 is shaped so as to define a channel that turns around the rear left corner of the drawer seat 227 and opens into the mixing chamber 269. The two electrovalves 270 and 271 are respectively connectable, by means of hoses, to a cold water and a hot water delivery ports intended to be present in the premises of the user where the appliance is to be located (in alternative embodiments of the invention, only one electrovalve may be present, for the connection to the cold water or hot water delivery port). Preferably, the conduits 290 and 291 are formed in a single-piece construction with the water load chamber 272, and are obtained by a plastic injection-moulding process. The two electrovalves are for example attached to the rear of the water load chamber by means of brackets.

The mixing chamber 269 opens at the bottom into a manifold 277 which is in fluid communication with the washing tub (for example, to this purpose a flexible hose, a bellow—not shown in the drawings—may be used), for delivering thereto the washing water, possibly mixed with the laundry treatment products, and the rinsing water.

Level sensors (not shown in the drawings) for sensing the level of laundry treatment products may be provided within, or be operatively associated with the two containers 201*a* and 201*b*. The level sensors, which may for example be one or more capacitive sensors, optical sensors, conductivity sensors, and may be mounted on the drawers, or on the drawer seat, for example along the side walls thereof, are used to provide the user with indications (for example, through visual indicators provided on the control panel 120) about the necessity of refilling the containers 201*a* and 201*b*.

An air space 273 is formed at the bottom of the drawer seat 227; the air space 273 is for example defined by the bottom walls of the drawer seat 227 and a (possibly removable, or formed in one piece with the drawer seat) panel 274 that separates the air space 273 at the bottom of the drawer seat 227 from the upper area 275 of the drawer seat 227 intended to accommodate the drawer 125. The air space 273 is in air communication with the washing tub, for example through the flexible hose or bellow that connects the manifold 277 to the washing tub). The air space 273 has a discharge aperture 276, that opens within the machine cabinet 105.

The user may extract the drawer 125 from its seat 227 and pour the desired laundry treatment products, e.g. detergent and/or softener (depending on the washing cycle he/she wishes the machine to perform) into the proper containers 201*a* and/or 201*b* formed in the drawer 125. When the drawer 125 is pulled out, as in FIGS. 2A and 2C, the elbow portions 221 of the suction pipes 213*a* and 213*b* are extracted from the respective valve bodies 235*a* and 235*b*; the bias springs 249 bias the valve members 241 into a position in which the aperture(s) 247 formed in the perimeter walls thereof are not in communication with the liquid chamber 259. When, after having poured the desired treatment products into the containers 201*a* and 201*b* formed in the drawer 125, the user pushes the drawer 125 fully into its seat 227, the two elbow portions 221 penetrates into the first portions 237 of the valve bodies 235*a* and 235*b*, and the rims of the free ends of the elbow portions 221, abutting the rim of the valve members 241, push the latter against the bias action of the bias springs 249. The valve members 241 thus slide rearward until the apertures 247 formed in the perimeter walls thereof open into the liquid chambers 259, and in this way a fluid path is established between the containers 201*a* and 201*b* and the pumps 265*a* and 265*b*. When either the pump 265*a* or the pump 265*b* is activated (according to the timing of the washing program), it sucks a dosed amount of the respective treatment product, detergent and/or softener, from the container 201*a* or 201*b* formed in the drawer 125; the treatment product is then delivered to the mixing chamber 269, where it may be mixed with cold or hot water taken in from the water mains, and the mix thus obtained is then delivered to the washing tub.

The two containers 201*a* and 201*b* provide a bulk storage of laundry treatment products within the appliance; the capacity of the containers 201*a* and 201*b* may be higher than the amount of laundry treatment product necessary for one washing cycle, and may suffice for several washing cycles, so that the user no longer needs to pour into the appliance the laundry treatment products before starting every washing cycle. An auto-dosing of the treatment products is achieved thanks to the provision of the pumps 265*a* and 265*b*, which take from the containers 201*a* and 201*b* the precise amount of treatment product needed for the single washing cycle; this translates into a saving of laundry treatment products, with a beneficial impact also on the environment.

The water load chamber 272 provides a separation between the outlets of the electrovalves 270 and 271 and the mixing chamber 269 where the pipes 267*a* and 267*b* from the pumps 265*a* and 265*b* open. In this way, it is ensured that no laundry treatment product leaks into the electrovalves and returns to the cold/hot water mains.

The drawer results in fluid communication with the washing tub only through the pumps, thus vapours that originate in the tub during the laundry washing cannot be discharged through the drawer. The air space 273 in air communication with the washing tub defines a vapours discharge path that allows discharging vapours coming from the washing tub during the washing cycles; the vapours are discharged into the machine cabinet. The discharge of the vapours also prevents that the laundry treatment products stored in the containers 201*a* and 201*b* of the drawer 125 are heated up by the vapours, which is believed to be undesirable, since repeatedly heating up the laundry treatment products might alter their properties.

An advantage of this solution resides in that when the drawer 125 is pulled out of the seat 227 for, e.g., the replenishment of the treatment products containers 201*a* and 201*b*, any possible leakage of treatment products from the valve bodies 235*a* and 235*b* drops onto the cap 209, from where it can be easily removed by the user.

The drawer seat 227, the mixing chamber 269, the water load chamber 272, the manifold 277 may be formed as a single-piece component, obtained by a plastic injection-moulding process; this reduction of separated parts simplifies assembling operations.

FIGS. 3A-3D show another solution according to an embodiment of the present invention.

Figure 3A:
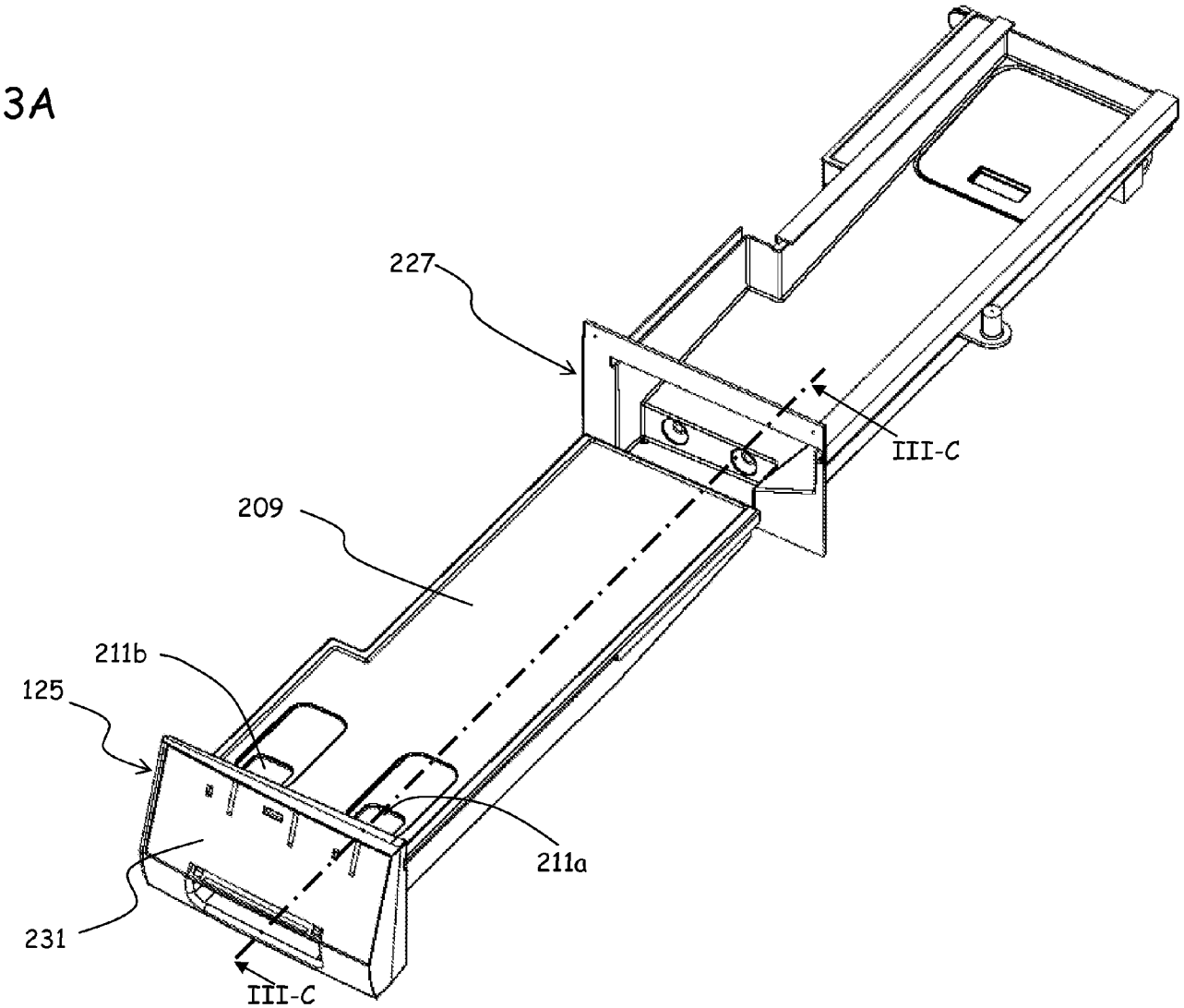
FIGS. 3A-3D show a solution according to another embodiment of the present invention, and in particular.
Figure 3B:
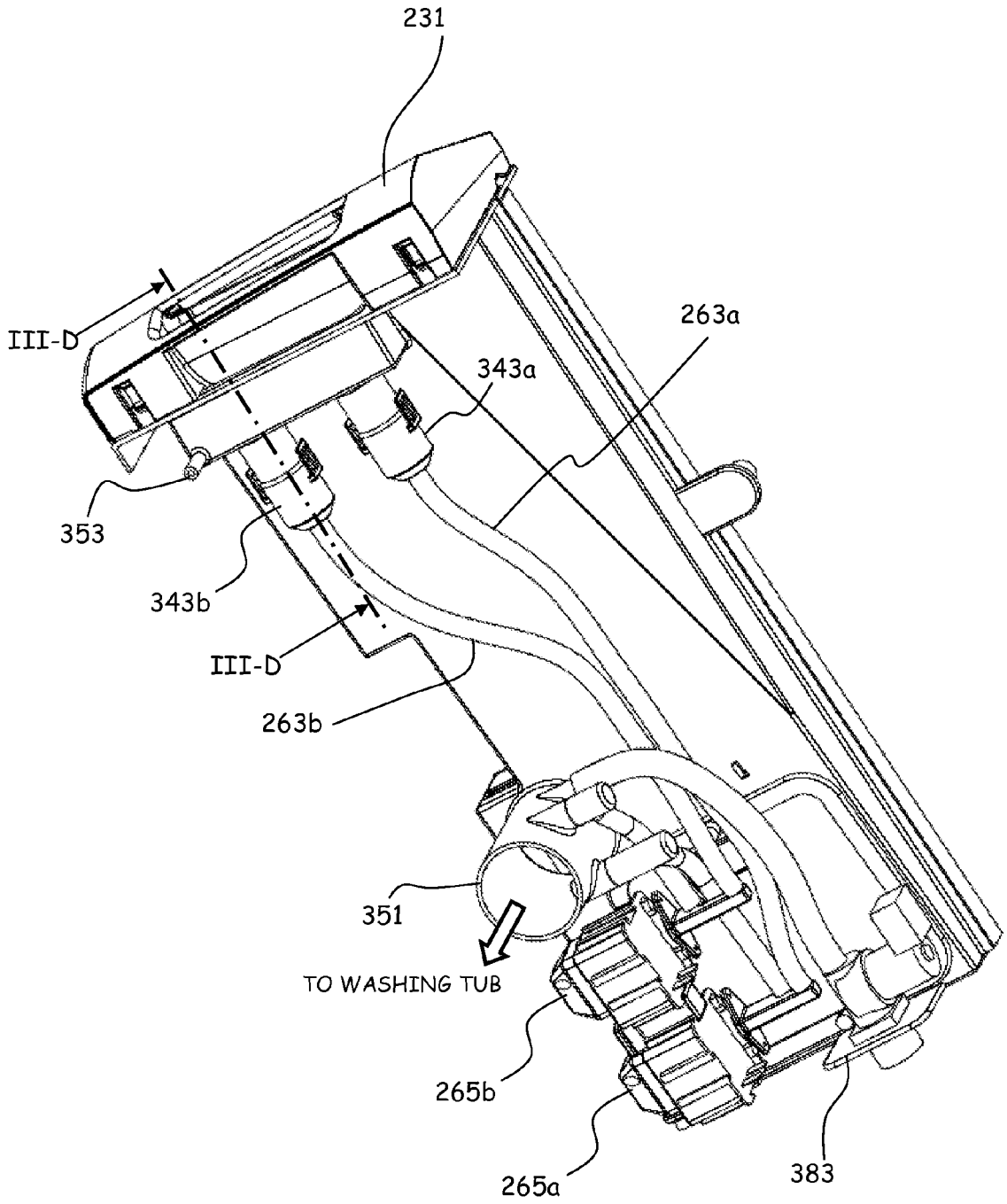
Figure 3C:
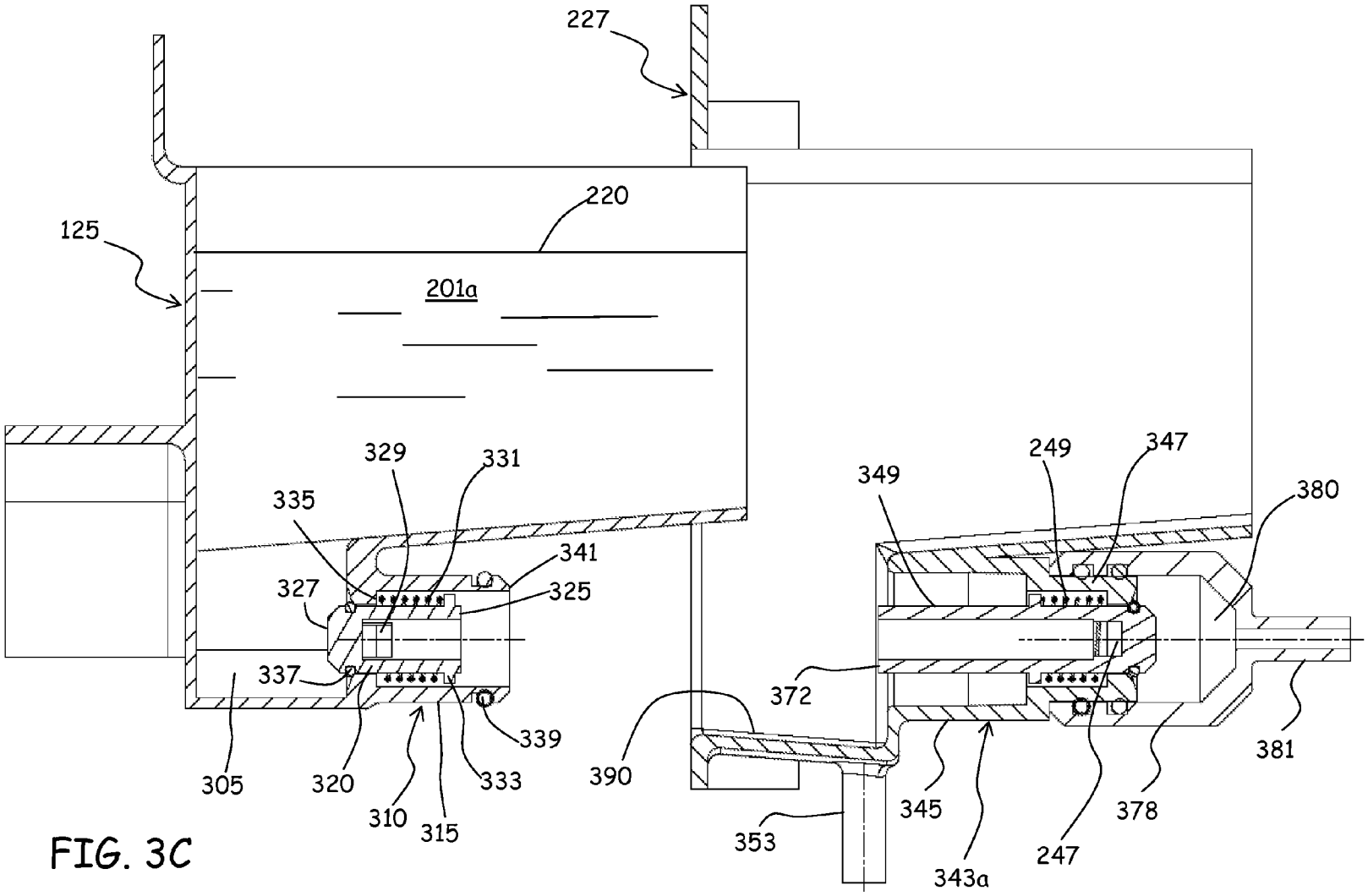
Figure 3D:
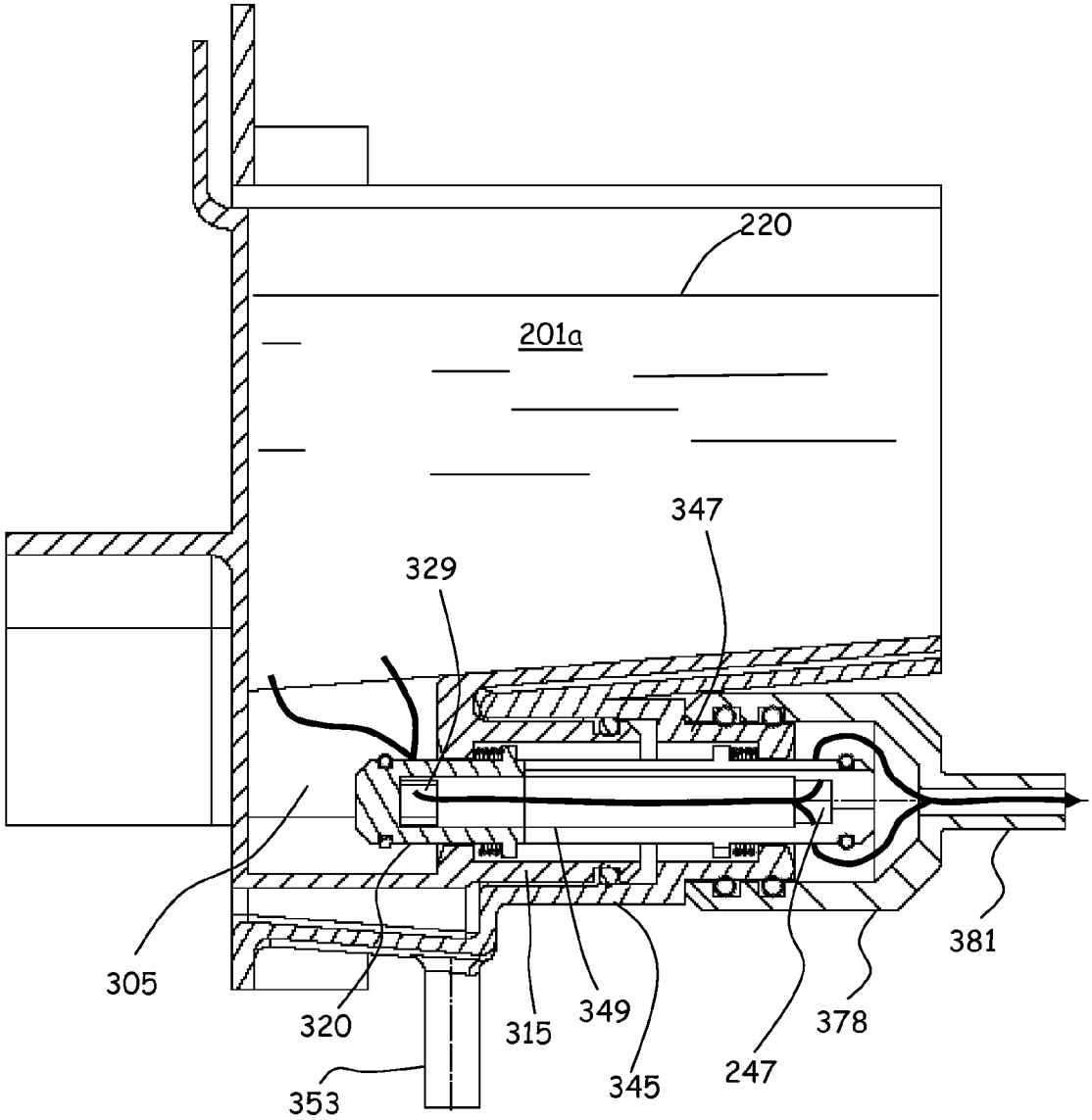
Figure 4A:
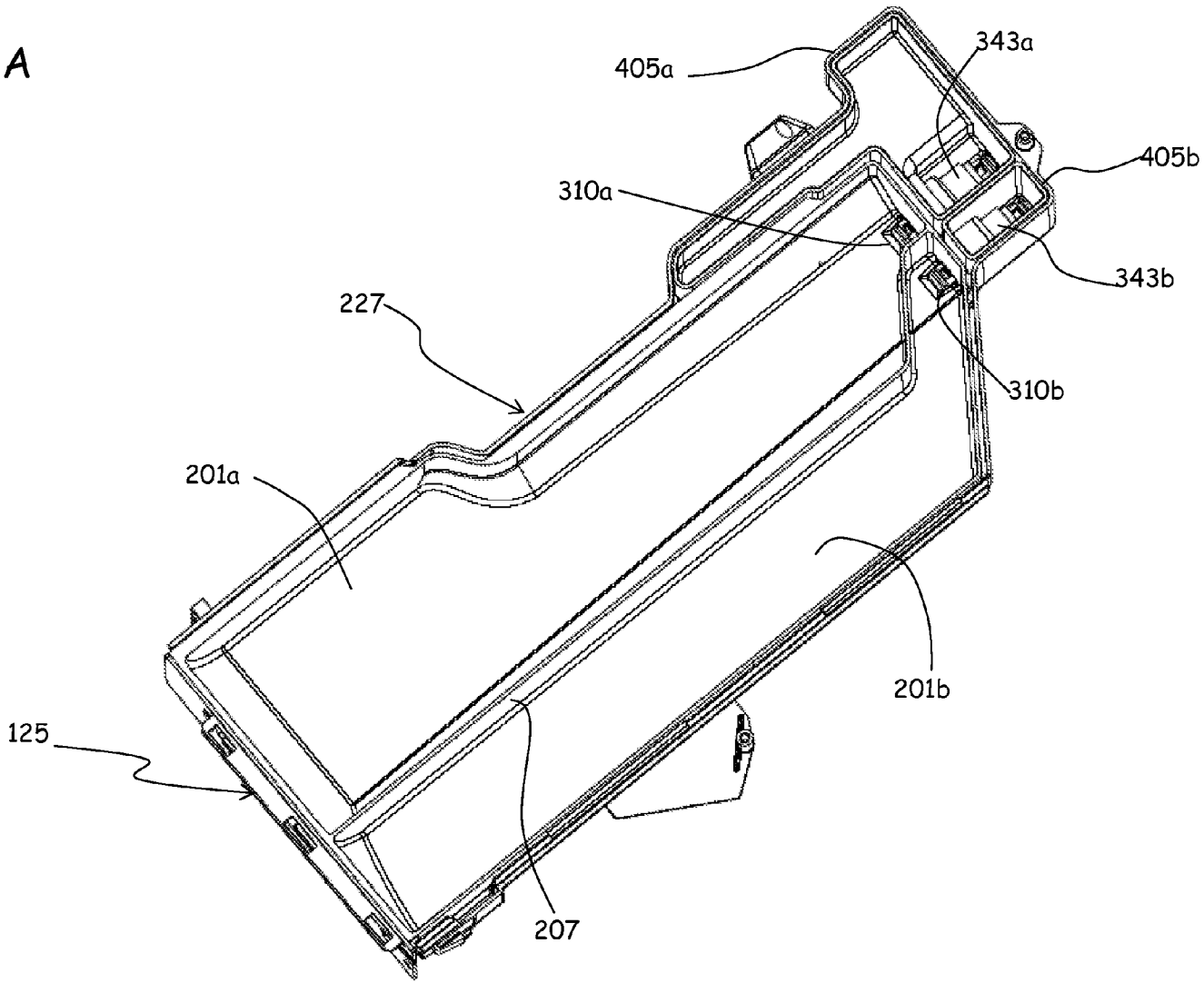
Figure 4D:
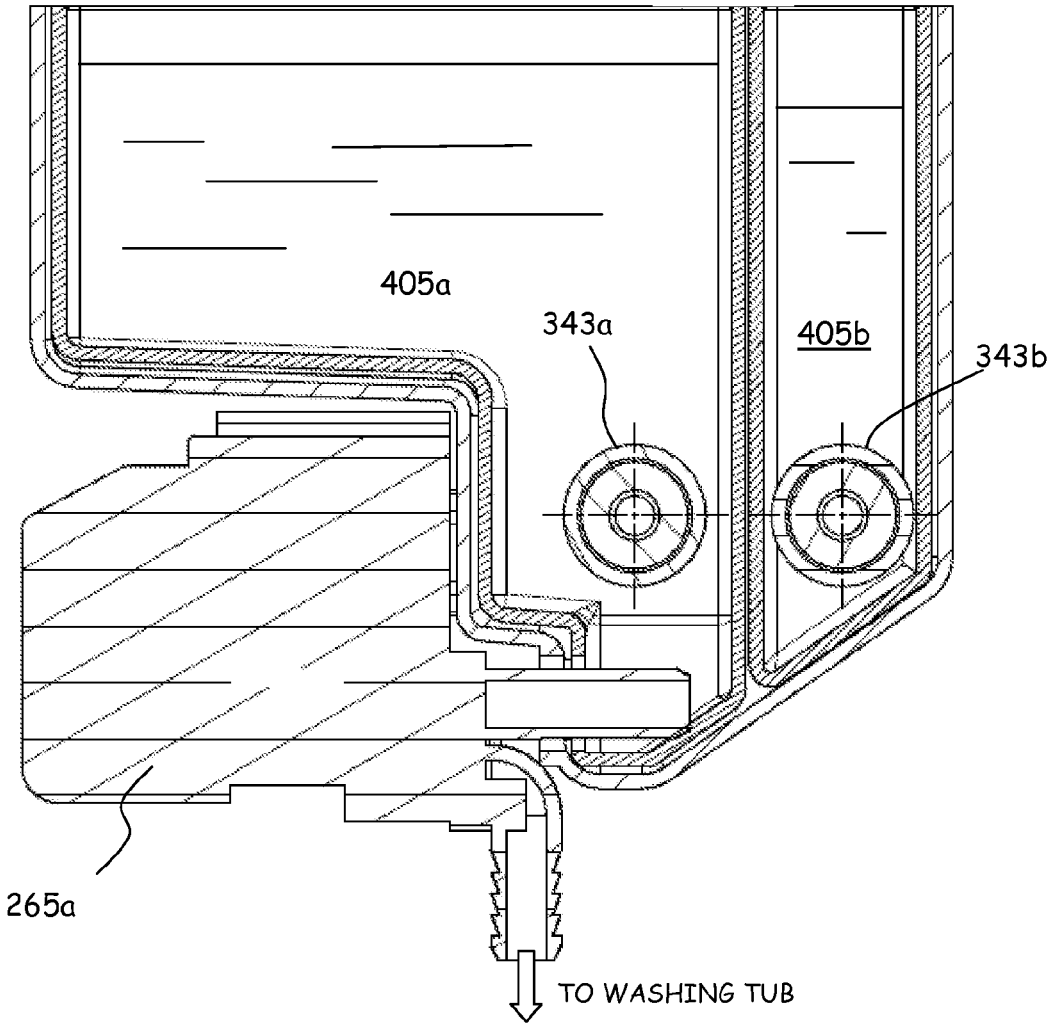
FIG. 4D is a cross-sectional view taken along the plane IV-D-IV-D of FIG. 4B.
Figure 4E:
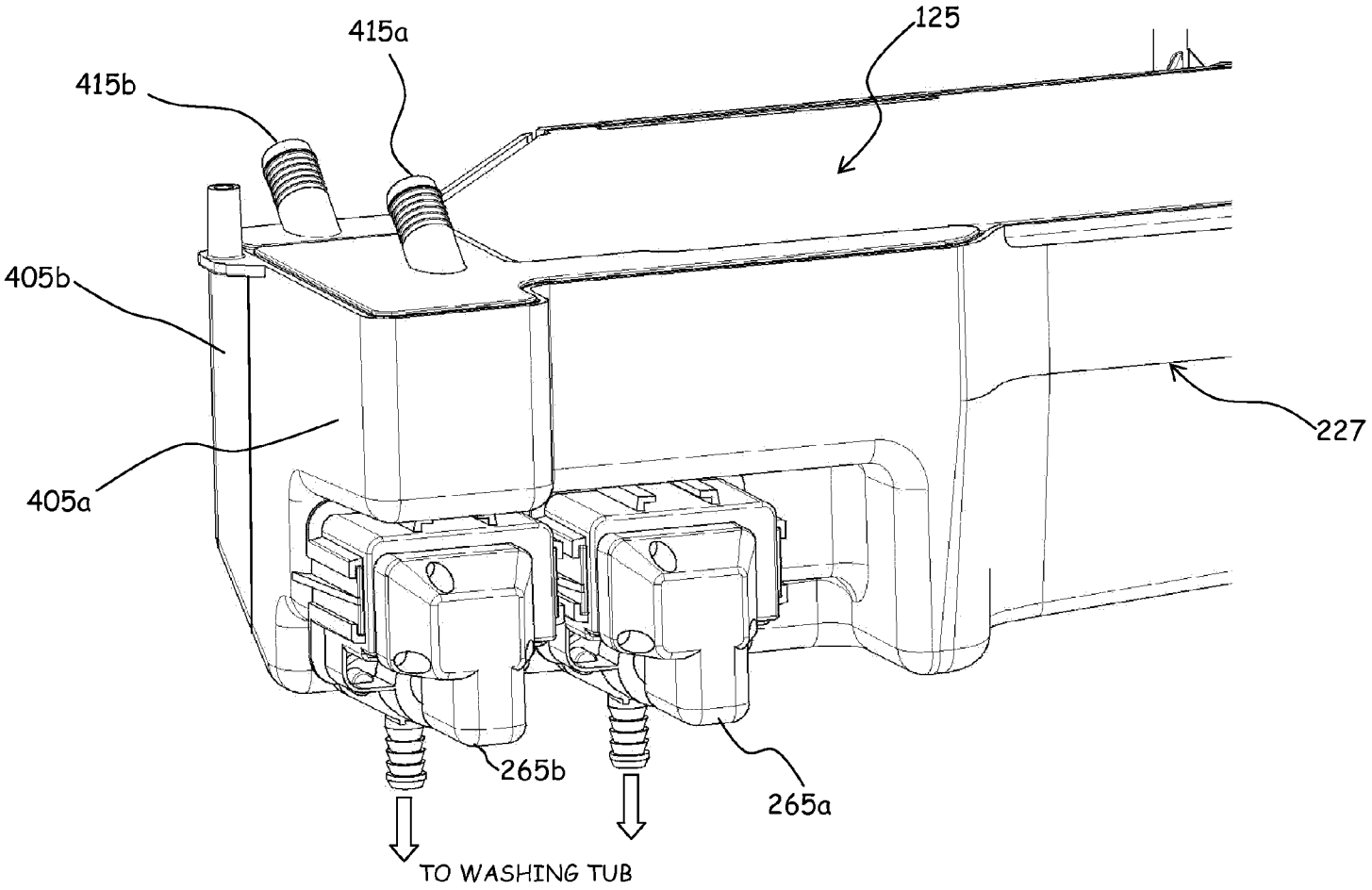
FIG. 4E is another perspective view of the drawer, seat and tanks assembly of FIG. 4A.

In greater detail, FIG. 3A shows in perspective view the drawer 125 in a fully pulled-out condition; FIG. 3B shows, in perspective from below, the drawer 125 fully inserted into the seat; FIG. 3C is a partial cross-sectional view taken along plane III-C-III-C of FIG. 3A; FIG. 3D is a partial cross-sectional view taken along plane III-D-III-D of FIG. 3B.

In this solution, at the bottom of each of the containers 201*a* and 201*b* defined by the drawer 125 a sump 305 is formed, at the front of the drawer 125 close to the front panel 231 thereof. Attached to the sumps 305 (in the shown example, formed in one piece with the drawer) are respective first valves 310, comprising a generically cylindrical and hollow first valve body 315 (in the example, also formed in one piece with the drawer) slidably accommodating a respective first valve member 320 forming a fluid passage cut-off element.

The first valve members 320 are hollow, generically cylindrical members, open at a first base 325 thereof opposite to the drawer front panel 231, and closed at an opposite, second base 327, with one or more apertures 329 formed in the perimeter wall thereof in correspondence of the second base 327, the aperture(s) 329 putting the hollow interior of the valve members 320 into fluid communication with the exterior. A bias helical spring 331 is fit outside each of the first valve members 320, between an annular ridge 333 projecting from the first valve member 320 perimeter wall close to the first base 325 thereof and a shoulder 335 formed in the first valve bodies 315. An O-ring 337 is fit on the first valve members 320 proximate to the second base 327 thereof, to ensure tight seal with the first valve bodies 315. An O-ring 339 is similarly fit on the free end portion 341 of the first valve bodies opposite to the sumps 305.

The seat 227 for the drawer 125 has, formed at a front bottom part thereof, two second valves 343*a* and 343*b*, each aligned with a respective one of the first valves 310. In front of the two second valves 343*a* and 343*b*, the seat 227 is shaped so as to define a lowered portion 390 that extends through the whole width of the seat 227 and is adapted to accommodate the first valves 310.

The second valves 343*a* and 343*b* are similar in construction to the valves of the first solution described above. Each of the two second valves 343*a* and 343*b* comprises a hollow valve body positioned so as to result aligned to the first valve body 315 of a respective one of the first valves 310, and has a first portion 345 of shape and size adapted to tightly receive therein the first valve bodies 315 of the first valves 310, the O-rings 339 providing a tight seal when the first valve bodies 315 of the first valves 310 are inserted into the first portions 345 of the second valve bodies. The second valve bodies have a second portion 347 following the first portion 345 and accommodating a second slidable valve member 349 forming a fluid passage cut-off element. The second valve member 349 is similar to the valve member 241 of the valves of the first solution described above, but has a greater extension, so that the open base 372 thereof slightly protrudes from the front opening of the first portion 345.

Similarly to the first solution described above, a pipe coupling 378 is fit onto the second portion 347 of the second valve bodies, and the pipe coupling 378 extends farther towards the rear of the cabinet 105 with respect to the second portion 347 of the second valve bodies to define a liquid chamber 380, and terminates with a nipple 381 adapted to the connection of the flexible pipes 263*a*, 263*b* leading to the intake of the suction pumps 265*a* and 265*b*. The pumps 265*a* and 165*b* are mounted below the drawer seat 227, at the rear thereof. In the exemplary embodiment shown, only one electrovalve 383 is provided, also positioned below the drawer seat 227, for example for the fluid connection to a cold water outlet in the premises of the user, and no water load chamber is provided, the outlets of the suction pumps 265*a* and 265*b* and of the electrovalve 383 being directly connected (through respective pipes) to a manifold 351 acting as a mixing chamber, and to which the flexible tube or bellow for delivering water and treatment products into the washing tub is coupled. Preferably, as visible in the shown example, at least the water, and possibly also the laundry o treatment products, enter tangentially into the manifold, so as to create a vortex that facilitates the mixing. Also, in order to create an air-gap for avoiding any possible return of washing treatment products into the water main, the conduits from the pumps' outlets open into the manifold 351 downstream (below)the height at which the conduit from the electrovalve opens.

The manifold 351 is preferably in single-piece construction with the drawer seat 227, and is obtained by a plastic injection-moulding process.

Also in this case, level sensors may be associated with the containers 201*a*, 201*b* for sensing the level of laundry treatment products present therein.

Preferably, at the bottom of the seat 227 for the drawer 125, approximately under the frontal open end of the first portions 345 of the second valve body associated with the container 201*b*, a discharge conduit 353 is provided in the lowered part 390 of the seat 227, for allowing the discharge of any treatment products residue that might drop from any of the second valves when the drawer 125 is pulled out; the discharge conduit 353 may for example lead into the washing tub (through a flexible pipe, for example).

It is pointed out that although in the shown example no discharge path for the vapour originating in the washing tub is present, nothing prevents from providing it.

The user may extract the drawer 125 from its seat 227 and pour the desired laundry treatment products, e.g. detergent and/or softener (depending on the washing cycle he/she wishes to be performed by the machine) into the proper containers 201*a* and/or 201*b* formed in the drawer 125. When the drawer 125 is pulled out, as in FIGS. 3A and 3C, the valve bodies 315 of the first valves 310 are extracted from the respective second valve bodies; the bias springs 331 bias the first valve members 320 into a position in which the aperture(s) 329 formed in the perimeter walls thereof are not in communication with the sumps 305, so no treatment product drips from the containers 201*a* and 201*b*. Similarly, the bias springs 249 bias the second valve members 349 into a position in which the aperture(s) 247 formed in the perimeter walls thereof are not in communication with the liquid chamber 259. When, after having poured the desired treatment products into the containers 201*a* and 201*b* formed in the drawer 125, the user pushes the drawer 125 fully into its seat 227, the valve bodies 315 of the first valves 310 penetrates into the first portions 345 of the second valve bodies, and the rims of the facing ends of the first and second valve members 320 and 349 abut and press one against the other against the bias action of the respective bias springs 331 and 249. Thus, the first and second valve members 320 and 349 move in opposite directions, until the aperture(s) 329 formed in the perimeter wall of the first valve members 320, and the apertures 247 formed in the perimeter walls of the second valve members 349 open into the sumps 305 and the liquid chamber 380, respectively; in this way a fluid path is established between the containers 201*a* and 201*b* and the pumps 265*a* and 265*b*. When the pumps 265*a* and 265*b* are activated (according to the timing of the washing program), they suck the respective treatment product, detergent and/or softener, from the container 201*a* or 201*b* formed in the drawer 125; the treatment product is then delivered to the washing tub.

An advantage of this solution compared to the embodiment described in the foregoing resides in that the top of the drawer 125 is essentially free, being that the valves and the pipes are located below; this may facilitate the user in the pouring of the treatment products into the containers 201*a* and 201*b*. Also, the position of the pumps 265*a* and 265*b* and of the electrovalve 383 under the drawer seat 227 reduces the overall dimensions of the laundry treatment products dispensing arrangement.

FIGS. 4A-4E show still another solution according to an embodiment of the present invention. This solution is similar to that of FIGS. 3A-3D, but in this case, the first valves 310*a* and 310*b*, associated with the containers 201*a* and 201*b* formed in the drawer 125, are located at the rear of the drawer 125, and the second valves 343*a* and 343*b*, associated with the drawer seat 227, are similarly located at the back of the seat 227 itself, essentially where the suction pumps 265*a* and 265*b* are mounted (the pumps are not visible in FIG. 4A, being located below the seat 227. In this way, the flexible pipes that were necessary in the previously described solutions are no longer necessary, and this translates into a reduction in parts, easier assembling, and thus less costs.

Also, in the solution of FIGS. 4A-4E, two tanks 405*a* and 405*b* are provided in (and attached to) the cabinet 105, for the two treatment products; the two tanks 405*a* and 405*b* can be put in fluid communication with the respective container 201*a* and 201*b* by means of the first and second valves 310*a* and 310*b* when the drawer 125 is fully inserted into the seat 227. The suction pumps 265*a* and 265*b* have their intake connected to the respective tank 405*a* and 405*b*, so that the treatment products to be delivered to the washing tub are taken from the tanks 405*a* and 405*b*, instead of from the containers 201*a* and 201*b*, as in the previous embodiments.

Level sensors (not shown in the drawings) for sensing the level of the laundry treatment products are preferably provided in, or associated with, the tanks 405*a* and 405*b*.

The two tanks 405*a* and 405*b* are closed at the top by respective, preferably removable, caps 410*a* and 410*b*, in each of which a nipple 415*a* and 415*b* is preferably provided, for the fluid connection to the water intake electrovalve, in order to enable a cleaning of the tanks 405*a* and 405*b* by means of a flash of water.

Also in this case, the pumps 265*a* and 265*b* allows a precise auto-dosing of the amount of treatment products to be delivered to the washing tub. In order to refill the tanks 405*a* and 405*b*, the user may extract the drawer 125, pour into the containers 201*a* and 201*b* the treatment products, and then reinsert the drawer 125 into the seat.

The invention claimed is:

1. A laundry washing appliance comprising a cabinet accommodating a laundry washing tub and a dispensing arrangement for dispensing laundry washing treatment products to be used during laundry washing, the dispensing arrangement comprising:

a drawer slidable within a seat provided in the cabinet, the drawer defining at least one container for containing laundry washing treatment products;

at least one suction pump associated with the at least one container and fluidly connected to the laundry washing tub for delivering thereto dosed amounts of the treatment products from the container; and at least one valve for fluidly connecting the at least one container to the at least one suction pump, said valve being realized so as to automatically close and cut off the fluid connection between the at least one container and the at least one suction pump when the drawer is at least partially extracted from the seat, and to automatically open and establish the fluid connection between the at least one container and the at least one suction pump when the drawer is pushed into the seat;

wherein:

the at least one valve comprises at least a valve portion that is attached to the drawer seat, said valve portion being arranged at the top of the drawer seat, so that the drawer is slidable within the seat below the at least one valve portion, or at the bottom of the drawer seat, so that the drawer is slidable within the drawer seat above the valve portion, or on the back of the drawer seat; and said at least one valve comprises:

at least one valve body;

at least one fluid passage cut-off member movable within the valve body between a first position in which the fluid passage is cut off, and a second position in which the fluid passage is enabled;

a respective bias member associated with the at least one fluid passage cut-off member for biasing it into the first position when the drawer is at least partially extracted from the seat, and a push member for pushing the bias member into the second position against the action of the bias member when the drawer is pushed into the seat.

2. The laundry washing appliance of claim 1, wherein the valve body is mounted to the drawer seat, and the push member is mounted on the drawer.

3. The laundry washing appliance of claim 2, wherein the push member comprises a first, terminal portion of a suction pipe having a second portion penetrating into the container.

4. The laundry washing appliance of claim 3, wherein the first, terminal portion of the suction pipe is arranged at the top of the drawer, and the valve body is arranged at the top of the drawer seat, so that the drawer is slidable within the drawer seat below the valve body.

5. The laundry washing appliance of claim 1, wherein the at least one valve body comprises a first valve body, mounted to the drawer, and a second valve body, mounted to the drawer seat in alignment with the first valve body, each of the first and second valve bodies having a respective fluid passage cut-off member movable therewithin and biased by a said respective bias member into the first position when the drawer is even partially extracted from the seat, the fluid passage cut-off members having facing ends which, when the drawer is pushed into the seat, about one against the other, whereby each of the fluid passage cut-off members acts as a push member for pushing the other fluid passage cut-off member into the second position.

6. The laundry washing appliance of claim 5, wherein the first valve body is mounted at the bottom of the drawer, below said at least one container, and the second valve body is mounted at the bottom of the drawer seat, so that the drawer is adapted to slide within the drawer seat above the second valve body.

7. The laundry washing appliance of claim 1, further comprising a vapours discharge path fluidly connected to the washing tub for discharging vapours that, in operation, originate within the washing tub.

8. The laundry washing appliance of claim 7, wherein the vapours discharge path comprises an air space formed at the bottom of the drawer seat and a discharge opening into the cabinet.

9. The laundry washing appliance of claim 1, wherein said at least one container comprises two containers, respectively for a washing detergent and a softener.

10. The laundry washing appliance of claim 1, further comprising at least one laundry washing treatment product tank fluidly connected to the at least one container by means of said at least one valve, an inlet of said at least one suction pump being connected to the tank, thereby the at least one suction pump being arranged to suck dosed amount of treatment products from the treatment product storage tank.

11. The laundry washing appliance of claim 1, wherein the at least one suction pump is a positive displacement pump, operable to suck from the at least one container predetermined doses of the laundry washing treatment products.

12. The laundry washing appliance of claim 1, wherein the dispensing arrangement comprises a mixing chamber, the at least one suction pump associated with the at least one container being fluidly connected to the mixing chamber for delivering thereto dosed amounts of the treatment products, the mixing chamber being fluidly connected to a water inlet and to the laundry washing tub.

13. The laundry washing appliance of claim 12, further comprising a water feed channel connected to an outlet of at least one electrovalve which in use is connected to an external water main, the water feed channel being fluidly connected to the mixing chamber.

14. The laundry washing appliance of claim 13, wherein an inlet into the mixing chamber for the delivery of treatment product by the suction pump is located above an entrance into the mixing chamber of the water feed channel.

15. The laundry washing appliance of claim 13, wherein the mixing chamber and/or the water feed channel are in single-piece construction with the drawer seat.

* * * * *